US010858928B2

(12) United States Patent
Fontenot et al.

(10) Patent No.: US 10,858,928 B2
(45) Date of Patent: Dec. 8, 2020

(54) GAUGE ASSEMBLY AND METHOD OF DELIVERING A GAUGE ASSEMBLY INTO A WELLBORE

(71) Applicants: Jerod Fontenot, Broussard, LA (US); Michael Wayne Aymond, Broussard, LA (US); John Raggio, Spring, TX (US)

(72) Inventors: Jerod Fontenot, Broussard, LA (US); Michael Wayne Aymond, Broussard, LA (US); John Raggio, Spring, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 36 days.

(21) Appl. No.: 16/107,455

(22) Filed: Aug. 21, 2018

(65) Prior Publication Data

US 2020/0063549 A1 Feb. 27, 2020

(51) Int. Cl.

| | |
|---|---|
| ***E21B 47/01*** | (2012.01) |
| ***E21B 47/12*** | (2012.01) |
| ***E21B 47/06*** | (2012.01) |

(52) U.S. Cl.

CPC ..... *E21B 47/01* (2013.01); *E21B 47/06* (2013.01); *E21B 47/12* (2013.01)

(58) Field of Classification Search

CPC ..... E21B 47/01; E21B 47/12; E21B 47/06
See application file for complete search history.

(56) References Cited

U.S. PATENT DOCUMENTS

| | | | | |
|---|---|---|---|---|
| 2,308,072 A | | 1/1943 | Granger | |
| 2,776,564 A | * | 1/1957 | Franklin | E21B 23/08 73/152.01 |
| 2,844,206 A | | 7/1958 | Alford | |
| 3,087,338 A | | 4/1963 | Horbinski et al. | |
| 3,473,610 A | | 10/1969 | Lange | |

(Continued)

FOREIGN PATENT DOCUMENTS

| | | |
|---|---|---|
| GB | 1131892 A | 10/1968 |
| GB | 2093091 A | 8/1982 |
| WO | 2006091640 A2 | 8/2006 |

OTHER PUBLICATIONS

Ding, et al.; "Coreless Electromagnetic Coupling-Based Drillstem Telemetry Using Dual Electronic Gauges"; SPE Production & Operations; Feb. 2007; 7 pages.

(Continued)

*Primary Examiner* — Brad Harcourt
(74) *Attorney, Agent, or Firm* — Cantor Colburn LLP

(57) ABSTRACT

A gauge assembly deployable from a surface system into a subsurface system includes a device housing having a first end, a second end, and an intermediate portion extending therebetween. The intermediate portion includes an outer surface and an inner surface that defines a device receiving zone. A device is arranged in the device receiving zone. The device includes one of a pressure sensor, a temperature sensor, and a communication device. A control line is connected to the device and extends from the second end of the device housing to the surface system. A guide member is mounted to the first end of the device housing. The guide member includes a tapered end section that promotes deployment into the subsurface system.

11 Claims, 4 Drawing Sheets

(56) References Cited

U.S. PATENT DOCUMENTS

| | | | | |
|---|---|---|---|---|
| 5,033,297 | A * | 7/1991 | Gustafson | E21B 47/01 439/279 |
| 5,094,103 | A * | 3/1992 | Wicks, III | E21B 17/1021 166/250.06 |
| 5,731,517 | A | 3/1998 | Ma et al. | |
| 6,116,085 | A | 9/2000 | Moffatt et al. | |
| 2014/0111349 | A1* | 4/2014 | Roberson | E21B 47/122 340/854.8 |
| 2018/0068764 | A1* | 3/2018 | Head | E21B 17/003 |

OTHER PUBLICATIONS

Tinkham, et al.; "Wired BHA Applications in Underbalanced Coiled Tubing Drilling"; IADC/SPE 59161; IADC/SPE Drilling Conference; Feb. 23-25, 2000; 13 pages.

* cited by examiner

GAUGE ASSEMBLY AND METHOD OF DELIVERING A GAUGE ASSEMBLY INTO A WELLBORE

BACKGROUND

In the resource exploration and recovering industry, sensors, communication devices and the like are employed downhole for a wide variety of applications. Generally, sensors, communication devices and other elements are integrated into a tubular string and run into a wellbore. In some cases, sensors, communication devices and the like are mounted to an outside diameter of production tubing and run into the wellbore during a completion phase.

Adding or repairing a sensor, communication device or the like requires the withdrawal of the production tubing. Withdrawing production tubing is a costly endeavor. Costs are not only associated with the manpower and tools to remove the production tubing, but also with lost production time. Accordingly, the art would be appreciative of a system that allows sensors, communication devices and the like to be positioned downhole without the need to withdraw tubulars.

SUMMARY

Disclosed is a gauge assembly deployable from a surface system into a subsurface system including a device housing having a first end, a second end, and an intermediate portion extending therebetween. The intermediate portion includes an outer surface and an inner surface that defines a device receiving zone. A device is arranged in the device receiving zone. The device includes one of a pressure sensor, a temperature sensor, and a communication device. A control line is connected to the device and extends from the second end of the device housing to the surface system. A guide member is mounted to the first end of the device housing. The guide member includes a tapered end section that promotes deployment into the subsurface system.

Also disclosed is a resource exploration and recovery system including a first system including a control system, a second system fluidically connected to the first system through a tubular string. A gauge assembly extending from the first system into the tubular string. The gauge assembly includes a device housing having a first end, a second end, and an intermediate portion extending therebetween. The intermediate portion includes an outer surface and an inner surface that defines a device receiving zone. A device is arranged in the device receiving zone. The device includes one of a pressure sensor, a temperature sensors, and a communication device. A control line is connected to the device and extends from the second end of the device housing to the control system. A guide member is mounted to the first end of the device housing. The guide member includes a tapered end section that promotes deployment into the tubular string.

Further disclosed is a method of deploying a gauge assembly into a wellbore includes introducing a device including one of a pressure sensor, a temperature sensor and a communication device into a device receiving zone of a device housing including a guide member, connecting a control line to the device, passing the control line from the device housing, introducing the device housing into a tubular string, and lowering the device housing into the tubular string via the control line to a selected depth.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
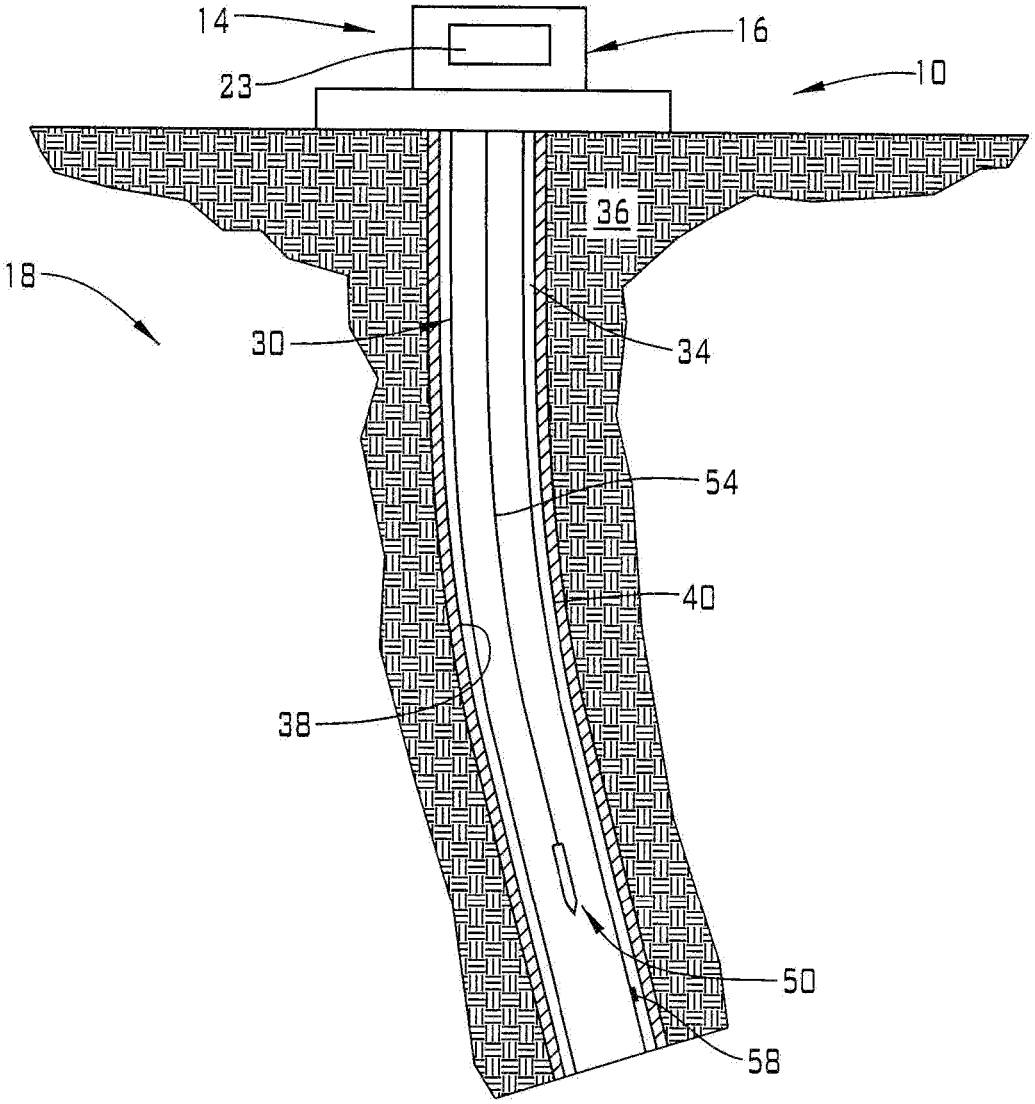
FIG. 1 depicts a resource exploration and recovery system including a gauge assembly, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subsurface system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string 30 that extends into a wellbore 34 formed in a formation 36. Tubular string 30 may be formed by a series of interconnected discrete tubulars or by a single tubular that could take the form of coiled tubing. Wellbore 34 includes an annular wall 38 which may be defined by a surface of formation 36, or, in the embodiment shown, by a casing tubular 40. It should be understood that wellbore 34 may also include an open hole configuration.

In accordance with an exemplary aspect, a gauge assembly 50 may be lowered into tubular string 30 via a control line 54. As will be detailed herein, gauge assembly 50 may be employed to detect and/or monitor downhole parameters such as temperature, pressure, or the like. Gauge assembly 50 may also be employed to communicate with a downhole tool or device 58 mounted to tubular string 30 or a downhole tool or device in an adjacent wellbore.

Figure 2:
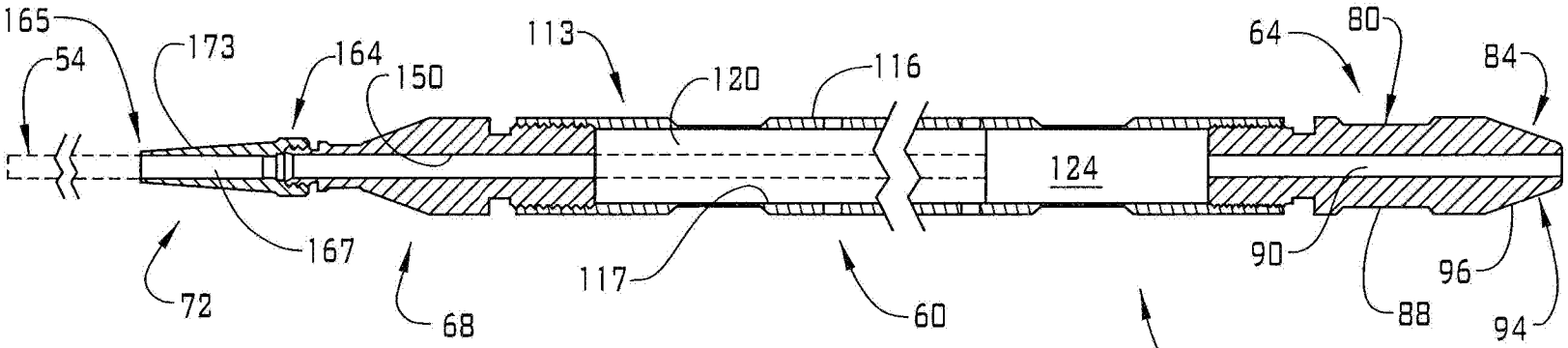
FIG. 2 depicts a cross-sectional side view of the gauge assembly of FIG. 1, in accordance with an aspect of an exemplary embodiment.
Figure 3:
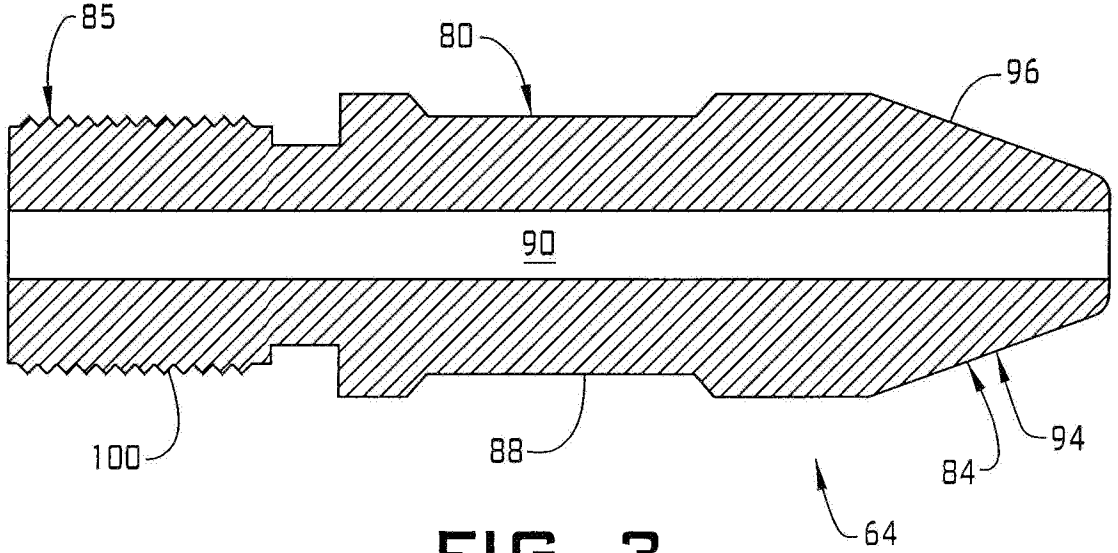
FIG. 3 depicts a cross-sectional view of a first end portion of the gauge assembly of FIG. 2, in accordance with an aspect of an exemplary embodiment.

Referring to FIG. 2, gauge assembly 50 includes a device housing 60 that supports a guide member 64, and end member 68 and a control line support 72. Guide member 64 promotes introduction of gauge assembly 50 into tubular string 30. Control line support 72 promotes or aids in the withdrawal of gauge assembly 50 from tubular string 30. Referring to FIG. 3, and with continued reference to FIGS. 1 and 2, guide member 64 includes a body 80 having a first end section 84 and a second end section 85. Guide member 64 includes an outer surface 88 and an inner passage 90. First end section 84 defines a tapered end section 94 having a tapered surface 96. Tapered surface 96 promotes an introduction and travel of gauge assembly 50 into tubular 30. Second end section 85 supports a plurality of threads 100.

Figure 4:
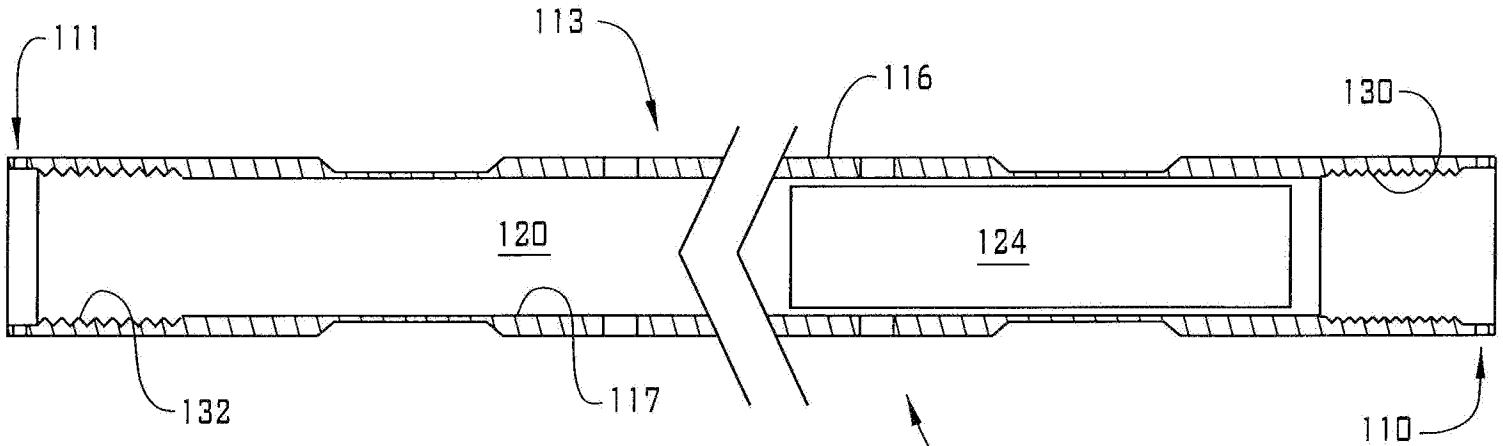
FIG. 4 depicts a cross-sectional view of a device housing portion of the gauge assembly of FIG. 2, in accordance with an exemplary aspect.

Referring to FIG. 4 and with continued reference to FIGS. 1 and 2, device housing 60 includes a first end 110, a second end 111 and an intermediate portion 113 extending therebetween. Intermediate portion 113 includes an outer surface 116 and an inner surface 117 that defines a device receiving zone 120. A device(s) 124 may be mounted in device receiving zone 120 and connected to control line 54. The number, position, and relative orientation of device(s) 124 may vary. Device(s) 124 may take on a variety of forms including pressure sensors, temperature sensors, communication devices, and the like.

Figure 5:
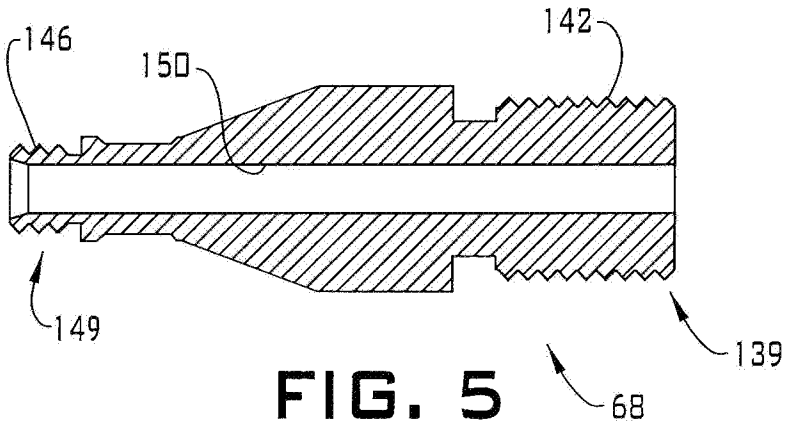
FIG. 5 depicts a cross-sectional view of a second end section of the gauge assembly of FIG. 2, in accordance with an exemplary aspect.

First end 110 include a plurality of threads 130 and second end 111 includes a plurality of threads 132. Guide member 64 may be mounted to first end 110 through an inter-engagement of threads 100 and 130. End member 68 may be supported at second end 111. Referring to FIG. 5, and with continued reference to FIGS. 1 and 2, end member 68 includes a first connector end 139 having a first plurality of threads 142 and a second connector end 144 having a second plurality of threads 146. First plurality of threads 142 engage with threads 132 on device housing 60. A passage 150 extends through end member 68. Passage 150 is designed to accommodate control line 54 passing from device 124.

Figure 6:
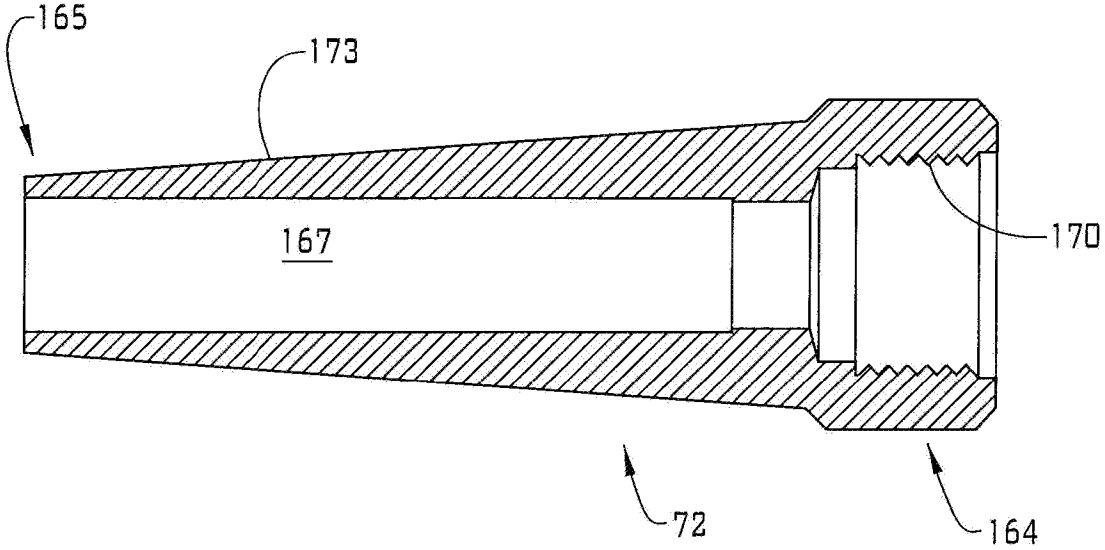
FIG. 6 depicts a cross-sectional view of a control line support of the gauge assembly of FIG. 2, in accordance with an exemplary aspect.

Referring to FIG. 6, and with continued reference to FIGS. 1 and 2, control line support 72 includes a first end 164 and a second end 165. A passage 167 extends between first and second ends 164 and 165. Passage 167 registers with passage 150 to accommodate control line 54. First end 164 includes a plurality of threads 170 that engage with second plurality of threads 146 on end member 68. Engagement between plurality of threads 170 and second plurality of threads 146 establishes a swag lock between control line support 72 and end member 68. Control line support 72 is shown to include a tapered surface 173 that promotes a snag free withdrawal of gauge assembly 50 from tubular string 30.

At this point it should be appreciated that the exemplary embodiments describes a gauge assembly that may be lowered into a tubular string via a control line. One or more devices, including sensors and/or communication devices may be installed into the device housing. The device housing may be closed by an end member and a guide member. A control line support may be connected to the device housing to support the control line and promote withdrawal of the gauge assemble. The guide member may include a passage that fluidically connects the wellbore with a device receiving zone. In this manner, the device may be directly exposed to downhole conditions.

The guide member may also be formed without a passage. The gauge member may be lowered into the tubular string to a selected depth to sense one or more downhole parameters to communicate with other downhole devices. In this manner, the need to integrate a sensor into the tubular string is avoided. Alternatively, the gauge assembly may be employed when an existing sensor and/or communication device no longer functions. Thus, with the gauge assembly, sensing and/or communication may continue without the need to pull out the tubular string to make repairs.

Set forth below are some embodiments of the foregoing disclosure:

Embodiment 1

A gauge assembly deployable from an surface system into a subsurface system comprising: a device housing including a first end, a second end, and an intermediate portion extending therebetween, the intermediate portion including an outer surface and an inner surface that defines a device receiving zone; a device arranged in the device receiving zone, the device including one of a pressure sensor, a temperature sensor, and a communication device; a control line connected to the device and extending from the second end of the device housing to the surface system; and a guide member mounted to the first end of the device housing, the guide member including a tapered end section that promotes deployment into the subsurface system.

Embodiment 2

The gauge assembly according to any prior embodiment, further comprising: an end member including a first end portion detachably mounted to the second end of the device housing, a second end portion, and an intermediate section defining a passage extending therebetween, the control line extending through the passage.

Embodiment 3

The gauge assembly according to any prior embodiment, wherein the end member is connected to the second end of the device housing through a plurality of threads.

Embodiment 4

The gauge assembly according to any prior embodiment, wherein the second end portion of the end member includes a plurality of threads.

Embodiment 5

The gauge assembly according to any prior embodiment, further comprising: a control line support detachable connected to the second end portion of the end member.

Embodiment 6

The gauge assembly according to any prior embodiment, wherein the control line support is swage locked to the second end portion of the end member.

Embodiment 7

A resource exploration and recovery system comprising: a first system including a control system; a second system fluidically connected to the first system through a tubular string; a gauge assembly extending from the first system into the tubular string, the gauge assembly including: a device housing including a first end, a second end, and an intermediate portion extending therebetween, the intermediate portion including an outer surface and an inner surface that defines a device receiving zone; a device arranged in the device receiving zone, the device including one of a pressure sensor, a temperature sensors, and a communication device;

a control line connected to the device and extending from the second end of the device housing to the control system; and a guide member mounted to the first end of the device housing, the guide member including a tapered end section that promotes deployment into the tubular string.

Embodiment 8

The resource exploration and recovery system according to any prior embodiment, further comprising: an end member including a first end portion detachably mounted to the second end of the device housing, a second end portion, and an intermediate section defining a passage extending therebetween, the control line extending through the passage.

Embodiment 9

The resource exploration and recovery system according to any prior embodiment, wherein the end member is connected to the second end of the device housing through a plurality of threads.

Embodiment 10

The resource exploration and recovery system according to any prior embodiment, wherein the second end portion of the end member includes a plurality of threads.

Embodiment 11

The resource exploration and recovery system according to any prior embodiment, further comprising: a control line support detachable connected to the second end portion of the end member.

Embodiment 12

The resource exploration and recovery system according to any prior embodiment, wherein the control line support is swage locked to the second end portion of the end member.

Embodiment 13

A method deploying a gauge assembly into a wellbore comprising: introducing a device including one of a pressure sensor, a temperature sensor and a communication device into a device receiving zone of a device housing including a guide member; connecting a control line to the device; passing the control line from the device housing; introducing the device housing into a tubular string; and lowering the device housing into the tubular string via the control line to a selected depth.

Embodiment 14

The method of any prior embodiment, further comprising: sensing a downhole parameter with the device.

Embodiment 15

The method of any prior embodiment, further comprising: communicating with a downhole tool with the device.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A gauge assembly deployable from a surface system into a subsurface system comprising:

a device housing including a first end, a second end, and an intermediate portion extending therebetween, the intermediate portion including an outer surface and an inner surface that defines a device receiving zone having a longitudinal axis;

a device arranged in the device receiving zone, the device including one of a pressure sensor, a temperature sensor, and a communication device;

an end member including a first end portion extending into and being detachably mounted to the second end of the device housing through a plurality of threads, a second end portion, and an intermediate section defining a passage extending therebetween;

a control line connected to the device and extending from the second end of the device housing to the surface system the control line extending through the passage in the end member;

a control line support detachably connected to the second end portion of the end member, the control line passing through the control line support; and a guide member mounted to the first end of the device housing, the guide member including a first end section, and a second end section, the first end section including a tapered surface that promotes deployment into the subsurface system and an inner passage that extends from the first end section through the second end section aligned with the longitudinal axis.

2. The gauge assembly according to claim 1, wherein the second end portion of the end member includes a plurality of threads.

3. The gauge assembly according to claim 1, wherein the control line support is swage locked to the second end portion of the end member.

4. The gauge assembly according to claim 1, wherein the inner passage is fluidically connected with the device receiving zone.

5. A resource exploration and recovery system comprising:

a first system including a control system;

a second system fluidically connected to the first system through a tubular string;

a gauge assembly extending from the first system into the tubular string, the gauge assembly including:

a device housing including a first end, a second end, and an intermediate portion extending therebetween, the intermediate portion including an outer surface and an inner surface that defines a device receiving zone having a longitudinal axis;

a device arranged in the device receiving zone, the device including one of a pressure sensor, a temperature sensors, and a communication device;

an end member including a first end portion extending into and being detachably mounted to the second end of the device housing through a plurality of threads, a second end portion, and an intermediate section defining a passage extending therebetween;

a control line connected to the device and extending from the second end of the device housing to the control system, the control line extending through the passage in the end member;

a control line support detachably connected to the second end portion of the end member, the control line passing through the control line support; and a guide member mounted to the first end of the device housing, the guide member including a first end section, and a second end section, the first end section including a tapered surface that promotes deployment into the second system and an inner passage that extends from the first end section through the second end section aligned with the longitudinal axis.

6. The resource exploration and recovery system according to claim 5, wherein the control line support is swage locked to the second end portion of the end member.

7. The resource exploration and recovery system according to claim 5, wherein the inner passage is fluidically connected with the device receiving zone.

8. A method of deploying a gauge assembly into a wellbore comprising:

introducing a device including one of a pressure sensor, a temperature sensor and a communication device into a device receiving zone of a device housing including a first end, a second end, and an intermediate portion extending therebetween defining a longitudinal axis, the device housing including a guide member having an inner passage arranged at the first end;

connecting a control line to the device;

passing the control line from the second end of the device housing;

introducing the device housing into a tubular string;

lowering the device housing into the tubular string via the control line to a selected depth; and passing downhole fluids through the inner passage of the guide member into the device receiving zone.

9. The method of claim 8, further comprising: sensing a downhole parameter with the device.

10. The method of claim 8, further comprising: communicating with a downhole tool with the device.

11. The method of claim 8, wherein passing the downhole fluids through the inner passage includes passing the downhole fluids through a passage that is aligned with the longitudinal axis.

* * * * *